United States Patent [19]

Blasius et al.

[11] Patent Number: 4,573,410

[45] Date of Patent: Mar. 4, 1986

[54] PRINTING PRESS WITH REGISTER MOTORS

[75] Inventors: Udo Blasius, Leimen; Karl-Heinz May, Viernheim; Anton Rodi, Leimen, all of Fed. Rep. of Germany

[73] Assignee: Heidelberger Druckmaschinen AG, Heidelberg, Fed. Rep. of Germany

[21] Appl. No.: 675,457

[22] Filed: Nov. 27, 1984

Related U.S. Application Data

[63] Continuation of Ser. No. 604,408, Apr. 27, 1984, abandoned, which is a continuation of Ser. No. 362,442, Mar. 26, 1982, abandoned.

[30] Foreign Application Priority Data

Mar. 27, 1981 [DE] Fed. Rep. of Germany ..... 3112189

[51] Int. Cl.[4] ..... B41F 31/04; B41L 27/06

[52] U.S. Cl. ..... 101/365; 101/DIG. 26

[58] Field of Search ..... 101/365, DIG. 26, 366, 101/148; 318/696, 567, 601, 603, 625, 640, 643; 340/825.07, 825.11

[56] References Cited

U.S. PATENT DOCUMENTS

| | | | |
|---|---|---|---|
| 3,835,777 | 9/1974 | Krygeris | 101/350 |
| 3,930,447 | 1/1976 | Murray | 101/365 |
| 4,193,345 | 3/1980 | Schoneberger | 101/365 |
| 4,200,932 | 4/1980 | Schramm et al. | 101/350 X |

FOREIGN PATENT DOCUMENTS

| | | | |
|---|---|---|---|
| 2024457 | 1/1980 | United Kingdom | 101/DIG. 26 |
| 2073663 | 10/1981 | United Kingdom | 101/350 X |
| 2080201 | 2/1982 | United Kingdom | 101/DIG. 26 |

*Primary Examiner*—J. Reed Fisher

*Attorney, Agent, or Firm*—Herbert L. Lerner; Laurence A. Greenberg

[57] ABSTRACT

A printing press, in particular an offset printing press comprising a plurality of individually operable setting motors, in particular for adjusting the inkfilm density profile, each setting motor being connected to a pick-up generating electric signals characteristic of the actual position of the setting motor at any given moment (actual values) comprises an electronic comparator arrangement (35, 44) which is supplied with the actual values and, in addition, desired values for the position of the individual setting motors (9) and which repeatedly scans the actual values sequentially in a cyclical time sequence and compares each actual value with the related desired value to form a setting signal for operation of the associated setting motor in the forward or reverse direction when a given positive or negative minimum deviation is exceeded. The setting signals are fed to a switching arrangement (52) designed to cause the respective setting motor to be stopped or driven at a predetermined speed in the sense of rotation determined by the last setting signal until the next signal is received. Thus it is rendered possible to easily control a plurality of setting motors.

16 Claims, 9 Drawing Figures

PRINTING PRESS WITH REGISTER MOTORS

This application is a continuation of application Ser. No. 604,408, filed Apr. 27, 1984, now abandoned which was in turn a continuation of parent application Ser. No. 362,442, filed Mar. 26, 1982, now abandoned.

The present invention relates to a printing press, in particular an offset printing press comprising a plurality of individually operable setting register motors, in particular adjusting the ink film density profile, each setting motor being connected to a pick-up generating electric signals characteristic of the actual position of the setting motor at any given moment (actual values).

To guarantee the ink/water equilibrium on the printing plate of an offset press in the presence of different ink densities, it has been known in the art to supply the printing plate with the ink quantity exactly required by using an arrangement in which the ink is supplied to the ductor which receives the ink from the ink fountain through a gap of adjustable width. This can be achieved by an undivided ductor blade taking the form of a flexible metal strip which can be deformed by means of adjusting screws in accordance with the desired ink film density profile. Machines of more recent design use a divided ductor blade composed for instance of an aligned series of excentrically rotatable control cylinders which, depending on their position, provide a passage of smaller or greater width through which the printing ink is fed to the ductor. In a known machine of this type produced by applicant and equipped with a CPC control system, the signals emitted by the pick-up are converted into an optical light-emitting diode indication which enables the width of the gap existing at any time to be seen by the printer on a display. A pair of two keys provided for each of the setting motors permits the printer to operate the setting motor in the forward or reverse sense until he can see on the display that the setting motor has reached the desired position, whereupon the printer will release the key and thus stop the setting motor.

The setting motors are d.c. motors and their sense of rotation is determined by the sense of the voltage with which they are supplied. In one embodiment of the before-mentioned known machine, 32 control cylinders serving a single inking unit are arranged in series one beside the other. So, a multi-colour printing machine having, for instance, six printing units would require 192 setting motors, the setting of which before commencement of the printing process for a new copy would require a considerable amount of care and attention on the part of the printer.

Now, it is the object of the present invention to improve a machine of the above-described type with relatively simple means so that the setting motors will automatically move into their respective desired positions, though the printer must have the opportunity to observe this setting process and to interfere with it in individual cases if this should seem necessary to him for any reasons whatever on the background of his experience. The invention is intended for application not only to machines using the above-described control cylinders, but also to all other printing machines using a plurality of setting motors for the operation of any setting elements.

According to the invention, the above object is achieved in that an electronic comparator arrangement is provided which is supplied with the actual values and, in addition, desired values for the position of the individual setting motors, which sequentially and repeatedly scans the actual values in a cyclical time sequence, which compares the actual value with the related desired value to form a setting signal for operation of the associated setting motor in the forward or reverse direction when a given positive or negative minimum deviation is exceeded, or otherwise a setting signal to stop the said setting motor, and that the setting signals are supplied to a switching arrangement for causing the setting motor in question to stand still or to be driven, at a pre-determined speed, in the sense of rotation determined by the last setting signal until the next setting signal relating to the same motor is received.

The time interval between two successive scannings performed by the same pick-up through the comparator arrangement must be short enough to ensure that the angle of rotation of the setting motor, inclusive of the path through which the motor will continue to rotate after the stopping signal has been received, will be lower or equal to half the tolerance angle, i.e. the angle by which the actual position of the motor is permitted to differ from the theoretical nominal position in both senses of rotation if the deviation is still to be regarded as admissible in the particular application. Therefore, the motor will always come to a standstill within the tolerance range, provided it is within the said tolerance range when the scanning cycle is performed and provided further that the scanning speed has been correctly fixed giving due consideration to the motor speed. So, the motor cannot overrun the tolerance range which provides the advantage that it is not necessary to reverse the sense of rotation of the motors several times until it reaches its desired position. A further advantage is to be seen in the fact that the design of the comparator arrangement may be very simple because it is not necessary to determine the amount of the deviation of the actual position of the motor from its desired position for each scanning cycle. Rather, it will be necessary only to determine if the motor is within or without the above-described tolerance range; and for this reason the data to be determined and transmitted may be limited to the above-described data, namely the setting signals for the forward and reverse movement and the stop signal for the motor, and need not include any data representing the amount of the given deviation. The invention may also be used for setting the wet layer thickness, for instance by means of setting cylinders, or for setting the ductor rollers. Further, the machine of the invention may be provided with a manual control as described above, and several setting motors associated with different printing units may be running simultaneously during the setting process.

To ensure that the setting motor will be stopped with the least possible delay, the setting signals determined by the comparator arrangement are conveniently transmitted immediately to the switching arrangement.

In one embodiment of the invention, the switching arrangement comprises for each setting motor an electronic storage for storing the setting signal. Considering that the setting signal may have three different values, one single flip-flop will be insufficient for this purpose so that in the embodiment described hereafter two flip-flops have been provided for each storage.

The comparator arrangement may be directly connected to each of the switching arrangements associated with a setting motor; in one embodiment of the invention, however, the arrangement is such that the comparator arrangement generates, together with each setting signal, an address signal relating to the setting motor which is just being scanned and that the address signal is supplied to an address decoding circuit which transmits the setting signal to the addressed storage associated with the respective setting motor for being stored therein. The advantage of this embodiment is to be seen in the fact that the circuitry may be kept within relatively narrow limits which is of particular importance in cases where a large number of setting motors are to be served, as in the case of the printing machines described above.

To change the sense of rotation of d.c. motors, it has been known heretofore to make use of a semi-bridge circuit or a full-bridge circuit. In the first case, one connection of the armature is permanently connected to a fixed potential which we are going to call ground for our purposes, while the other connection is connected to a positive or negative potential, depending on the desired sense of rotation. In the case of the bridge circuit, the two connections of the armature are connected to different polarities, and if the sense of rotation is to be changed, the polarities of the two connections are interchanged.

To permit the selective use of the bridge connection or semi-bridge connection for the setting motors, with one and the same electronic circuit, the arrangement of one embodiment of the invention is such that the address coding circuit can be switched over in response to an operating mode signal representing two possible operating modes (semi-bridge connection, bridge connection), in a manner such that in the one operating mode (semi-bridge connection) one address is associated with one storage only, while in the other operating mode (bridge connection) one address is associated with two storages for storing signals of this type, and that the respective setting motor has its armature terminals supplied with different potentials for forward and reverse movement. As a rule, this operating mode signal will be fixed one and for all by the manufacturer and can therefore be formed by a permanently connected potential, the arrangement being conveniently such that this operating mode signal will fix the decoding mode of each address decoding circuit only in respect of a small number of outputs of the switching arrangement, for instance for only two outputs (here, one has the choice to realize two semi-bridge connections or one bridge connection) or for four outputs (here, four semi-bridge connections or two bridge connections are selectively possible). It is also possible to operate the setting motors of one printing machine using partly a bridge circuit and partly a semi-bridge circuit.

In one embodiment of the invention the comparator arrangement comprises an analog comparator for comparing the desired value with the actual values. In another embodiment of the invention the comparator arrangement comprises for this purpose a digital comparator which may substantially take the form of a subtractor.

In one embodiment of the invention, a logic braking circuit is provided which, when a "stop" setting signal is received, emits a control signal for a connected power stage with switches arranged in bridge connection, to switch on two switches connected to the same pole of the supply voltage source of the motor. This makes it possible to prevent excessive afterrunning of the setting motor where this should be necessary, a factor which is of particular importance because this afterrunning depends on factors which can be determined only with great difficulty and can therefore hardly be calculated exactly in advance. The braking arrangement may also be reversible in response to the above-mentioned operating mode signal so that the braking arrangement will become effective only when a full bridge circuit is used, as in the embodiment described below.

The setting motors for the above-described printing press require a current supply in the range of approximately up to 0.5 A per setting motor. If the above-mentioned full number of, say, 192 setting motors were to be started simultaneously, the total current required in the case of parallel connection, which is the only type of connection possible, would be so high that the resulting power supply unit would be uneconomically big and expensive, in particular if one considers that setting motors are in operation only for a few hours in each year. In the case of the known printing press described above, only very few of the setting motors will normally be running simultaneously.

In order to keep the total current required by the setting motors low, the embodiment of the invention has, therefore, provided a control arrangement behind the storage which ensures that the electric energy required for driving the setting motors is supplied during a pre-determined period of time only to one of several pre-determined groups of setting motors.

To achieve this, one could for instance make available the required energy to a pre-determined number, for instance eight, of the above-mentioned 192 setting motors until the setting process has been completed, and then supply the next group of eight setting motors, etc. If, however, it is desired to let less time pass between the operation of the first register motor and the operation of the last register motor than is the case in the application just described, it is also possible to supply each group of, say, eight motors with current for a period of, say, 0.5 seconds and to pass then on to the next group. Or, it would also be possible to considerably reduce the period of time during which each of the setting motors of one group is supplied with current, and even to reduce this period of time below the period of time passing between two successive scannings of a pick-up. Such relatively quick timing of the energy supply may prove convenient in cases where in a given printing press the setting motors run too quickly relative to the scanning speed of the comparator arrangement so that it would seem desirable to reduce their speed without thereby essentially reducing the torque delivered by the setting motors. This last-described operating mode is also considered to fall under the invention described in claim 1, as this timing of the energy supply does not influence the reliable operation of the invention. In particular, the phase position of the energy supply timing relative to the scanning of the actual values of the individual setting motors has no influence whatever on the reliable function of the machine of the invention.

One embodiment of the invention which may be realized in particular in connection with the control system just described and may, but need not necessarily, provide for the selection of different setting motor speeds as described before, provide that the comparator arrangement is capable of detecting when any of several different minimum deviations (corresponding to different tolerance ranges) is exceeded by the actual values, that a switching arrangement causes at the beginning of a setting process certain pre-determined setting motors to run at a first, pre-determined speed, the setting motors being stopped when a firsttolerance range is entered, and that the switching arrangement will then cause the same setting motors to run at a speed lower than the said first speed and switch the comparator arrangement over to a tolerance range smaller than the said first tolerance range. In this case, the setting motors are initially subjected to a rough adjustment with a great tolerance range (minimum deviation) corresponding to the relatively high speed, whereupon the minimum deviation can be reduced because of the reduced motor speed to permit fine adjustment of the setting motors to the desired position. The advantage of this arrangement is to be seen in the fact that the setting process can be accelerated as compared to those embodiments in which the setting motors can be run only at one speed, and this in particular when all setting motors are to be set for the first time. In the simplest of all cases, the arrangement may be such that the setting motors will be switched over to the reduced speed only when all setting motors capable of running at the described higher speed have been stopped after they have entered the first tolerance range of deviation. As a rule, it should be convenient to provide the described possibility of running at different speeds, as described above, at least for those setting motors which have a relatively large adjusting range. Conveniently, the arrangement may be such that not all of the setting motors will simultaneously run at the increased speed but that the number of motors running at any time at the increased speed is limited to a maximum of, say, 16 so that the power requirements to be covered by the power supply unit remain limited to relatively low values, as mentioned before. The reduced speed may be obtained by the timing described above.

Inspite of the relatively simple principle of the arrangement of the invention, the control of for instance 256 setting motors for which the circuit may be conveniently designed requires quite a considerable amount of logic circuitry to put the setting signals through to the individual setting motors.

In order to reduce, on the one hand, the number of components and to keep the number of connections to be made on circuit boards and, thus, the susceptibility to trouble, as low as possible, one embodiment of the invention provides that the switching arrangement comprises at least one integrated circuit comprising: power stages controllable in response to the setting signals, for connection of at least two setting motors, at least one address input for addressing the power stages, at least one data input for the setting signals and at least one storage device for each power stage for storing the setting signals. Preferably, the integrated circuit comprises power stages for connection of a total of four setting motors using a semi-bridge circuit, or two register motors using a bridge circuit; this embodiment is still easily realized, if one thinks of the external connections existing on conventional housings for integrated circuits and the power dissipation. Protection is sought also for the integrated circuit alone.

The integrated circuit is advantageously realized using the bipolar technology, for instance $I^2L$, or the MOS technology. These technologies permit the realization of logic circuits and power stages on one and the same semi-conductor wafer or chip.

Still other embodiments of the invention characterized in the claims create a possibility of effectively braking the setting motors and adapting the control levels of the power stages to the signal levels encountered in the logic circuit.

Hereafter, certain examples of the invention will be described in detail with reference to the drawings in which.

Figure 5:
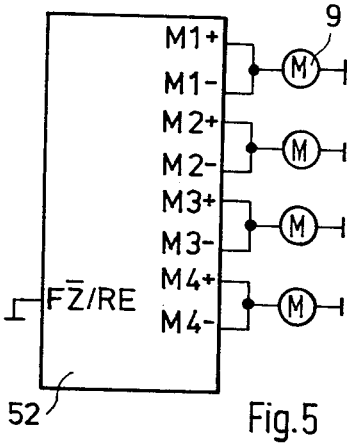
Figure 6:
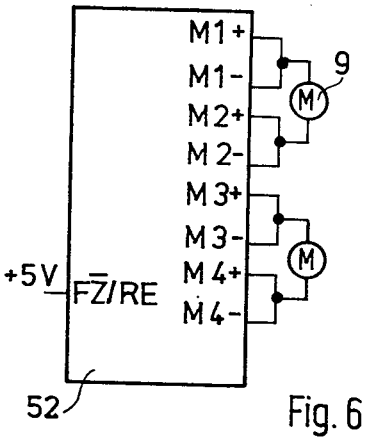
Figure 3:
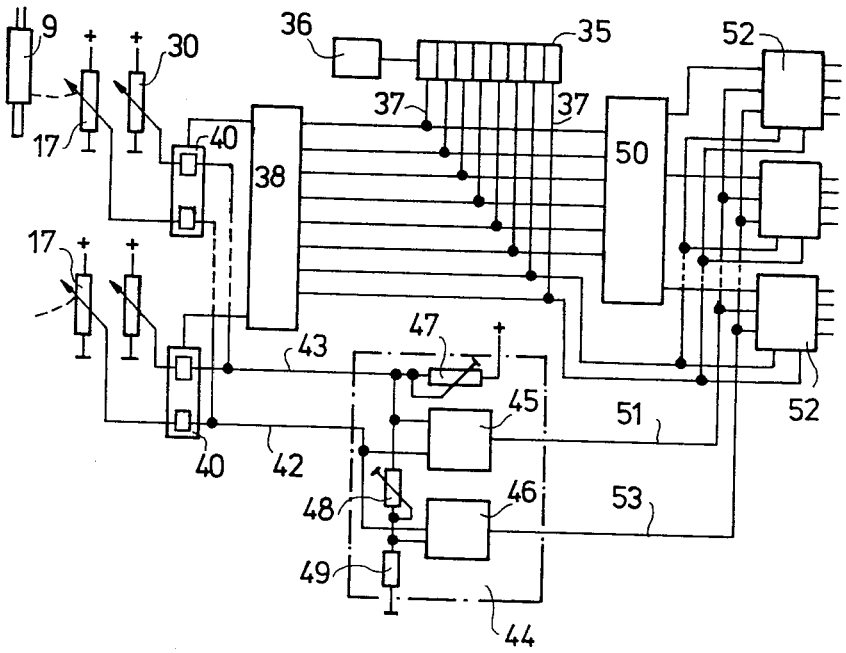
Figure 9:
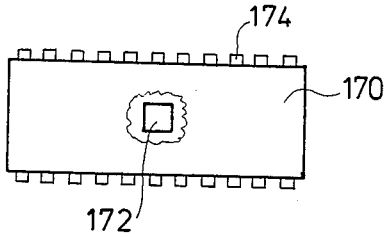
Figure 4:
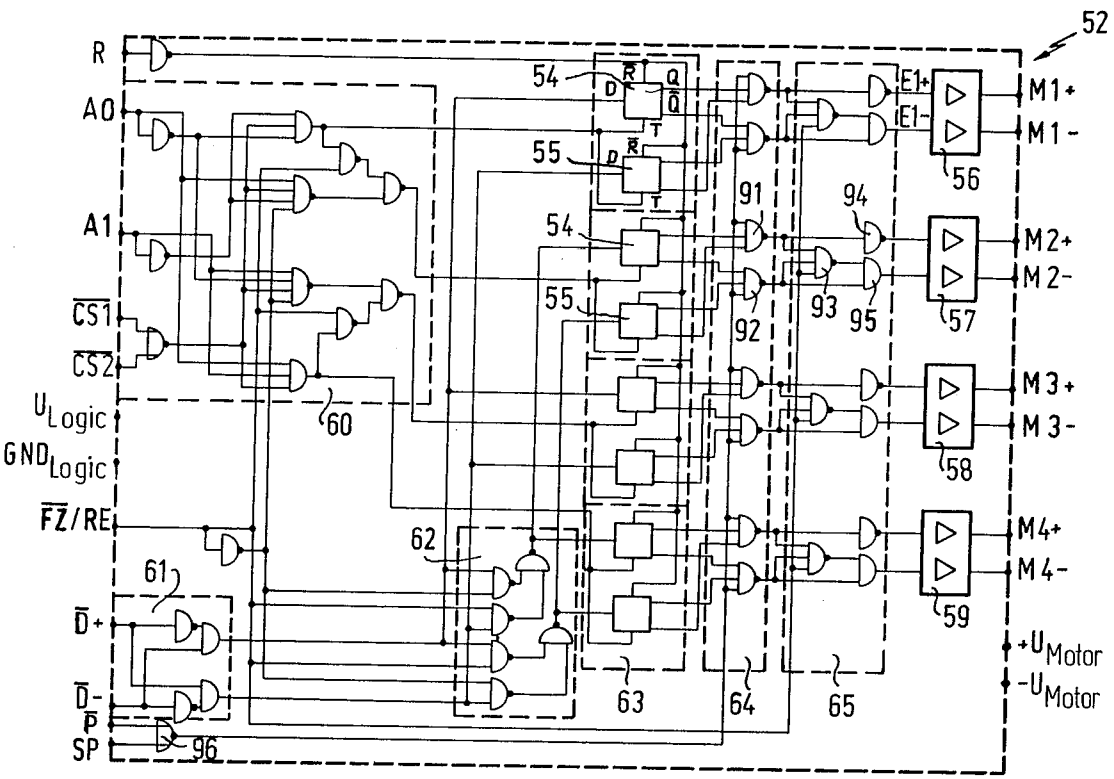
Figure 7:
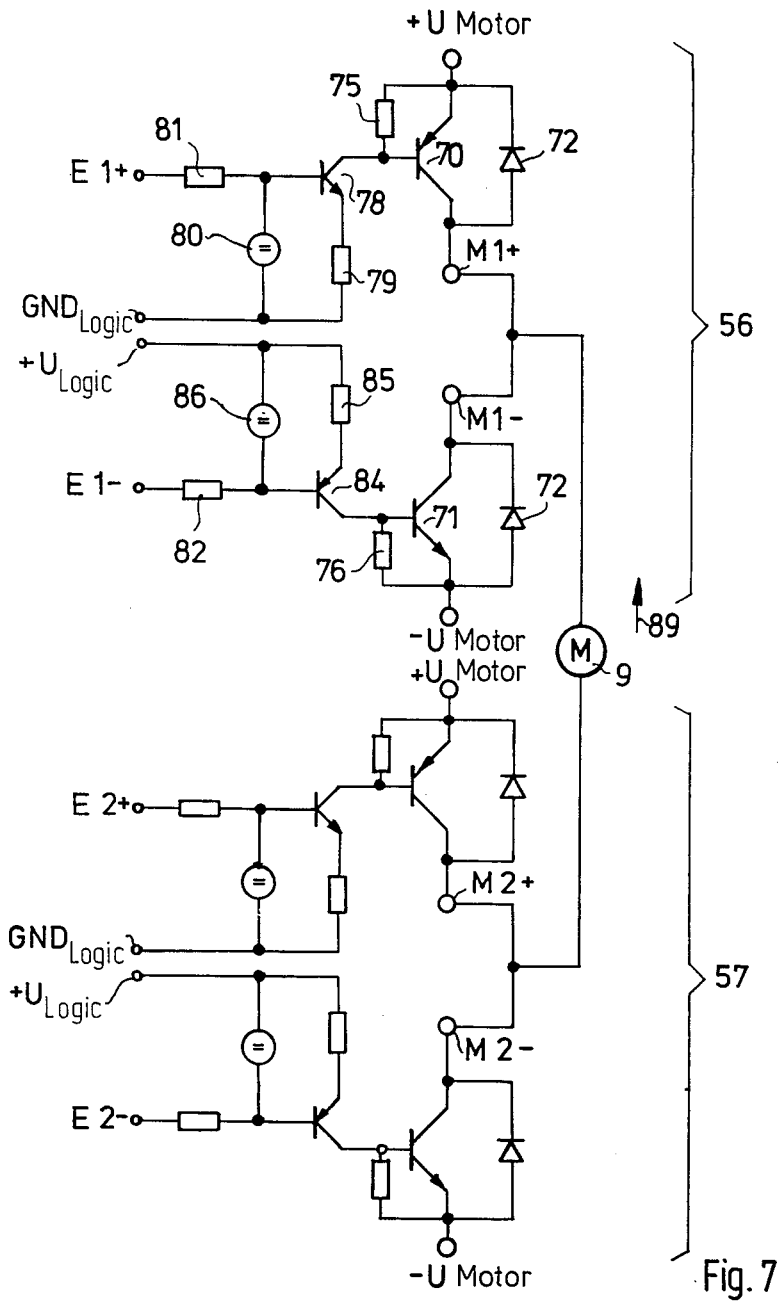
Figure 8:
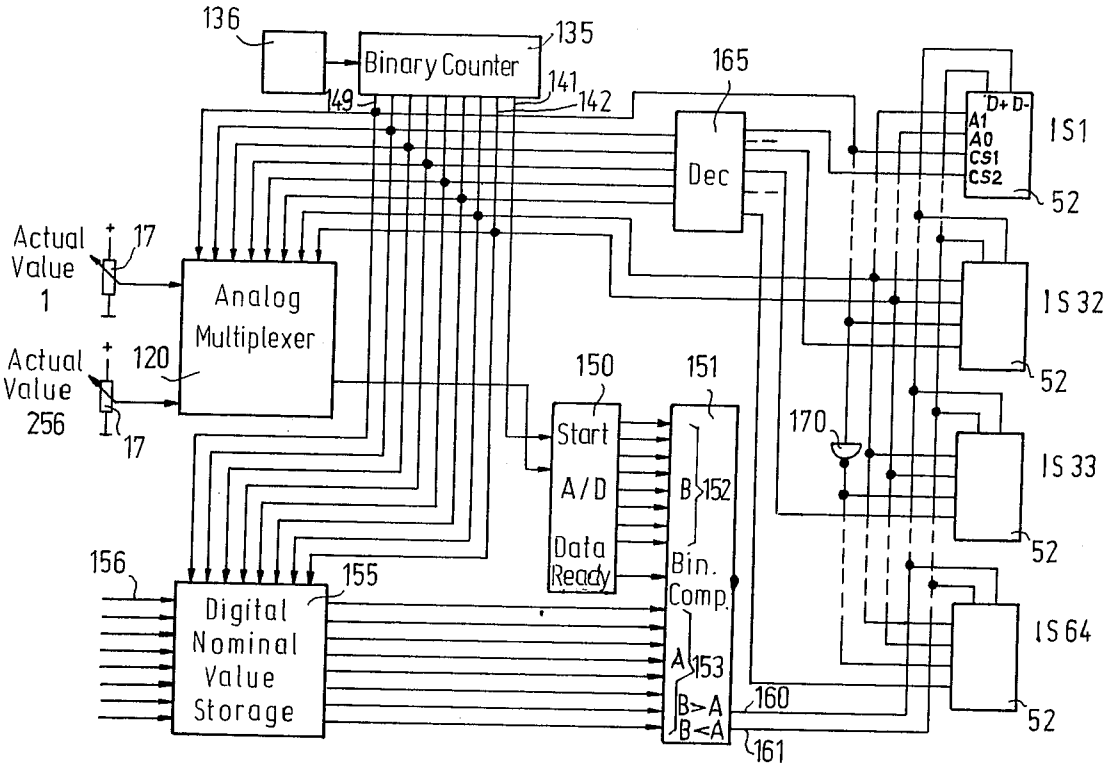

FIG. 3 a schematic diagram of the entire circuit arrangement for scanning the actual values and controlling the setting motors;

FIG. 4 the logic circit diagram of an integrated circuit employed in FIG. 3;

FIG. 5 a schematic representation of the semi-bridge connection of four register motors to an integrated circuit in accordance with FIG. 4;

FIG. 6 a schematic representation of the full-bridge connection of two register motors to an integrated circuit in accordance with FIG. 4;

FIG. 7 a full-bridge circuit;

FIG. 8 a schematic diagram of a circuit arrangement comprising a digital comparator arrangement;

FIG. 9 an integrated circuit.

Figure 1:
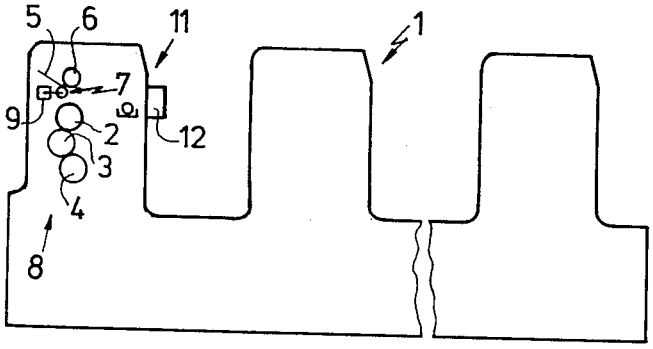
FIG. 1 is a simplified diagrammatic representation of a printing press in accordance with the invention.

FIG. 1 shows a side view, partly broken away, of an offset printing press 1 comprising eight printing units, with five of the printing units being not shown in the drawing. In one of the portions of the machine shown in the drawing certain parts of a printing unit 8 can be seen. The printing unit comprises a plate cylinder 2 carrying the printing plate and coacting with the blanket cylinder 3 which transfers printing ink to the paper to be printed as it passes between the blanket cylinder 3 and an impression cylinder 4. Of the associated inking unit, only the ink fountain 5 with ductor 6 are shown in the drawing. In the lower portion of the ink fountain 5, there is arranged a divided ductor blade 7 comprising a series of setting cylinders 15 (FIG. 2) each of which is connected to one setting motor 9. The printing unit 8 coacts in addition with a damping unit 11 comprising a water tank 12. Numerous other details, in particular transport cylinders for the printing ink and the water and transport rollers have for simplicity's sake been omitted from the drawing.

Figure 2:
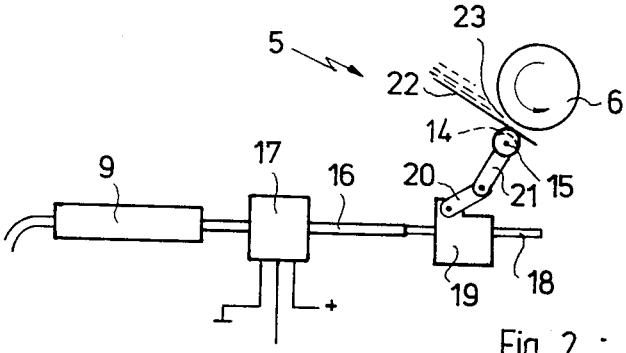
FIG. 2 is a diagrammatic representation of a setting motor coupled to a setting cylinder.

FIG. 2 shows in a simplified form the adjusting mechanism for one setting cylinder 15 of the divided ductor blade. The setting motor 9 which is designed as a d.c. motor drives a shaft 16 coupled to a potentiometer 17. The shaft 16 carries on its end a threaded section 18. Screwed to this section 18 is an adjusting piece 19 which is connected via a connecting rod 20 with a lever 21 which is in turn rigidly connected to the setting cylinder 15. The lower bottom of the ink fountain 5 is formed by a plastic film 22, and depending on the position of the setting cylinder 15 which comprises an excentric face 14, the said plastic film 22 is more or less pressed against the outer face of the ductor 6 so that a gap 23 of greater or smaller width is formed through which the ink may reach the lower portion of the ductor cylinder. Then, the ink is transferred to further cylinders of the inking unit in a manner not shown in the drawing. From the above it results that the setting cylinder 15 is adjusted by a displacement of the adjusting piece 19 caused by a rotary movement of the setting motor 9. Two of the electric connections of the potentiometer 17 are connected to a voltage source, while the wiper of the potentiometer 17 is taken out via a third line. Thus, the potentiometer permits exact electric measuring of the position which the setting cylinder 15 occupies at any given time. Each of the printing units of the printing press 1 has associated to it 32 setting cylinders 15 so that the machine 1 comprises a total of 256 setting cylinders and the same number of setting motors 9.

FIG. 3 shows only two of the 256 potentiometers 17. The dotted line beside the upper one is meant to indicate the mechanical actuation through the setting motor 9. Each of the potentiometers 17 supplying an actual value representative of the position of the setting motor 9 and, thus, of the setting cylinder 15, coacts with the potentiometer 30 whose wiper voltage represents the desired value for the position of the setting motor 9. In the simplest of all cases, the wiper of the potentiometer 30 can be adjusted by hand. But instead of a potentiometer 30, it is also possible to use any other adjustable storage for voltage values, including in particular a digital storage for digital voltage values which has its output connected to a digital-to-analog converter for generating, at the latter's output, a d.c. voltage representative of the stored digital value. The counting input of an eight-bit binary counter 35 is supplied at regular time intervals with pulses obtained from a pulse generator 36. The counter position is shown in the form of a binary number at the output 37, the possible number of different counter positions being 256. The binary number obtained at the output 37 forms an address for the individual potentiometers 17. There is provided a first decoding circuit 38 which has its inputs connected to the outputs 37. The first decoding circuit 38 has 256 outputs. Each pair of associated potentiometers 17 and 30 coacts with a switch 40 which is connected with exactly one output line of the first decoding circuit 38. The upper switch 40 in FIG. 3 is connected to that output of the first decoding circuit 38 which assumes a pre-determined potential when the counter 35 shows the counter position 255, while the lower switch 40 in FIG. 3 is connected to that output which assumes the said potential when the counter 35 shows the counter position 0. The said potential is encountered at any time at one only of the outputs of the said first decoding circuit 38. It produces a two-pole connection of the switch 40 so that the wiper of the associated potentiometer 17 is connected to a line 42 while the wiper of the associated potentiometer 30 is connected to a line 43. The said lines 42 and 43 are connected to the signal inputs of a comparator circuit 44 which comprises two individual comparators 45 and 46 which will each of them emit a positive output signal representative of the logic value 1 when the signal applied to their lower input on the left side is higher than the signal applied to their upper input on the left side. The voltage supplied by the wiper of the potentiometer 30 to the line 43 which represents the exact desired value for the rotary position of the associated setting motor 9 is somewhat raised above the resistance of an adjustable resistor 47 which has its other end connected to a positive voltage, this increase of voltage corresponding to the admissible deviation in upward direction of the rotary position of the setting motor 9 from the desired value. The raised voltage value is supplied to the upper input of the comparator 45, while the lower input of the comparator 46 is supplied with a voltage value lowered through an adjustable resistor 48 as against the voltage value supplied to the upper input of the comparator 45 by an amount corresponding to twice the amount of the deviation of the rotary position of the setting motor 9 from the desired value. The adjustable resistor 48 forms a voltage divider together with a resistor 49 which is connected to earth. The line 42 is connected to the lower input of the comparator 45 and the upper input of the comparator 46. Accordingly, a positive signal is obtained at the output of the comparator 45 when the voltage of line 42 is greater than a voltage corresponding to the respective desired value, plus the tolerance set by the resistor 47, while a positive signal is obtained at the output of the comparator 46 when the voltage of line 42 is lower than the desired voltage, reduced by the admissible deviation from the desired value. In all other cases, the output voltages of the comparators 45 and 46 are 0 V.

The six high-order outputs of the counter 35 are connected to a second decoding circuit 50 with 64 outputs, of which only one will assume a low potential in response to the counter position of the counter 35 which will serve as chip selection signal for selecting one of 64 integrated circuits 52. The two lowest-order outputs of the counter 35 are connected to two address inputs of each of the integrated circuits 52. The outputs of the comparators 45 and 46 are in addition connected via lines 51 and 53, respectively, to two data inputs of each integrated circuit 52. Each integrated circuit 52 comprises four outputs permitting the semi-bridge connection of four register motors 9 or the bridge connection of two register motors 9.

FIG. 4 shows the logic diagram of the integrated circuit 52 which comprises inverters, AND elements, NAND elements, NOR elements and flip-flops represented by the known symbols, and in addition four identically designed power stages 56 to 59. In the extreme left portion of FIG. 4 all connections for the operation of the logic circuits are shown. A reset input R serves to reset all flip-flops when switching on the power supply for the electronic circuits shown so as to ensure defined initial conditions. The outputs A0 and A1 are supplied with the address signals furnished by the two lowest-order outputs of the counter 35. There are provided two negated chip selection inputs CS1 and CS2, one of these inputs being connected to exactly one of the outputs of the second decoding circuit 50, the other one being connected to 0 V. Now, when a chip selection signal of low potential (earth) is encountered, the condition $CS1=0$ is fulfilled, and the addresses supplied to the inputs A0 and A1 can be evaluated. The presence of two chip selection inputs may in many cases simplify the addressing process. There are provided two additional connections (U, GND) for the voltage supply of the logic circuit. An input $\overline{FZ}$/RE serves to switch over from semi-bridge connection to full-bridge connection. When this input is connected to earth, which is equal to logic 0, four setting motors may be connected by semi-bridge connection to the final stages 56 to 59, and when the input $\overline{FZ}$/RE is connected to a positive voltage of for instance 5 volts, one setting motor may be connected, by full-bridge connection, to each of the final stage pairs 56/57 and 58/59, respectively.

The data inputs $\overline{D}+$ and $\overline{D}-$ are supplied with setting signals appearing on the lines 51 and 53, which may also assume the logical values 0 and 1. Two inputs $\overline{P}$ and SP of equal rank make it possible to block the final stages 56 to 59, for instance for impulse operation, without thereby influencing the storages.

The extreme right and lower portion of FIG. 4 shows connections for a positive and a negative supply voltage for the setting motors to be connected. In the example described here, these voltages are equal to +15 volts and −15 volts. The power stages 56 to 59 have two outputs each, the upper one permitting the positive supply voltage of +15 volts and the lower one permitting the negative supply voltage of −15 volts to be selectively connected through to a connected setting motor.

The integrated circuit 52 comprises several functional units, including an address decoding system 60 responsive to the operating mode, which will associate to a specific address supplied to the connections A0 and A1 either exactly one of the power stages 56 to 59 or one of the pairs 56, 57 or 58, 59 of the power stages, depending on whether the integrated circuit 52 is switched to semi-bridge connection or full-bridge connection. A data interlocking system 61 ensures that only one of the two outputs can assume the logic value 1 or that both outputs have the logic value 0. The data interlocking system 61 provides safety against disturbances in case the logical signal 1 should be encountered for any reason whatever simultaneously on the lines 51 and 53. An operating mode responsive data decoding arrangement 62 will supply the data, i.e. the setting signals, only to the storage associated with one specific power stage or else to the storages associated with one pair of power stages 56, 57 or 58, 59, depending on whether the integrated circuit 52 is switched to semi-bridge connection or full-bridge connection. The eight flip-flops 54, 55 are united, by the dotted line, to one storage unit 63. These flip-flops are connected in groups of two to power stages which fact is similarly indicated by dotted lines. Each of the flip-flops 54, 55 comprises a pulse input T, a reset input $\overline{R}$, a data input D and a non-inverting and an inverting output Q and $\overline{Q}$, respectively. The flip-flops 54, 55 are pulse-controlled (Latch) and store the information contained in them at the end of the timing pulse. As long as the timing pulse is present, the storage content follows the input signal.

A functional unit termed pulse signal processing unit 64 evaluates the input signal obtained at the inputs $\overline{P}$ and SP to block the power stages 56 to 59 in response to these signals. The pulse signal processing unit 64 is connected to the output end of the storage unit 63 and has for its effect to mutually interlock the output signals of the two flip-flops 54 and 55 supplied to one power stage. An operating mode responsive braking logic 65 ensures in the case of full-bridge connection that those pairs of power stages 56, 57 and 58,59 which are not supplied with control signals for forward or reverse motion of the connected register motor, and the connections of the armature of the register motor are connected to the same potential, in our example −15 volts. So, the armature of the register motor is short-circuited and will, therefore, be rapidly braked. In the event the armature should already have stopped, any undesirable movement of the armature, for instance by vibrations, will be prevented.

The circuit set-up of all logic elements which are part of the pulse signal processing unit 64 and the operating mode responsive braking logic 65 and which are connected to the output ends of each pair of flip-flops 54 and 55 forming conjointly a storage associated with exactly one power stage is identical in all cases. The elements in question comprise three NAND elements 91, 92, 93, one negator element 94 and one AND element 95. The output of the negator element 94 is connected to the upper inputs of each of the associated power stages 56 to 59, i.e. to the inputs E1+, E2+, etc. The output of element 95 is connected to the other input of each of the power stages.

The input of element 94 is connected to the output of element 91. The one input of the element 95 is connected to the output of the element 93, while its other input is connected to the outputt of element 92. The inputs of element 93 are connected to the outputs of the elements 91 and 92 and to the input $\overline{FZ}$/RE of the integrated circuit 52. The inputs of element 91 are connected on the one hand to the output of one NOR element 96 which has its inputs connected to the control inputs $\overline{P}$ and SP of the integrated circuit 52, while the other inputs of the element 91 are connected to the non-inverting output of the flip-flop 54 and the inverted output of the flip-flop 55. One input of element 92 is again connected to the output of element 96, and the two other inputs are connected to the invering output of the flip-flop 54 and the non-invering output of the flip-flop 55.

The braking logic 65 formed by the elements 93, 94 and 95 ensures that when the storage content of the flip-flops 54 and 55 shows the logic values 0;0 in the case of semi-bridge connection, the signals 0;1 are applied to the inputs of the associated power stages 56 to 59 and that, accordingly, the two outputs M+ and M− of this power stage are switched off, whereas in the case of full-bridge connection and the same storage content 0;0 the logic level 0 is encountered at the inputs of the two coacting power stages, for instance 56 and 57, so that the output M− of both power stages is at the negative motor supply voltage and electric braking of the motor becomes possible.

In the case of semi-bridge connection, the following combinations of address signals supplied to connections A1, A0 are associated with the following power stages: 0;0 with 56, 0;1 with 57, 1;0 with 58, 1;1 with 59.

In the case of full-bridge connection, the following address signals supplied to inputs A1, A0 are associated with the following pairs of power stages: 0;0 with 56 and 57, 1;1 with 58 and 59. Therefore, only one address line will be required, provided permanent wiring.

For the following combinations of setting signals supplied to the data inputs $\overline{D}$+ and $\overline{D}$− it will be stated hereafter whether they result in a standstill of the motor connected to the addressed power stage or the addressed power stage pair, or whether they will result in forward or reverse motion of the motor. For this purpose, forward motion shall be defined as that sense of rotation of the motor which is obtained in the case of semi-bridge connection when the respective power stage supplies to the motor a positive voltage, and in the case of full-bridge connection when the upper—as seen in FIG. 4—of the two power stages to which the motor is connected supplies to the motor a positive voltage. The statements apply to both, full-bridge and semi-bridge connection.

0;1=forward motion;
1;0=reverse motion;
0;0=stop.

FIG. 5 shows in a simplified form how four setting motors 9 can be connected, by semi-bridge connection, to an integrated circuit 52. Here, the two outputs of each power stage 56, 57, 58, 59, which in the case of the power stage 56 are designated as M1+, M1− are interconnected, and a setting motor 9 is connected between the point of connection and earth. The two outputs of each of the power stages 56 to 59 could also be interconnected within the integrated circuit 52. They have;

however, been taken out to enable a setting motor operating in one sense only or another load to be connected to each individual output, if this should become necessary. In this case it should, however, be ensured that the two outputs can be controlled independently of each other. In the arrangement shown in FIG. 5, the logic input $\overline{FZ}$/RE is connected to earth, i.e. to logical 0.

In the arrangement shown in FIG. 6, the logic input $\overline{FZ}$/RE is connected to +5 volts, which voltage value constitutes the logical level 1. The two outputs of any one of the final stages 56 to 59 are again interconnected, and a setting motor 9 is connected between the joint outputs of the power stages 56 and 57, while another setting motor 9 is connected between the interconnected outputs of power stage 58 and power stage 59.

FIG. 7 shows the circuit diagram of one embodiment of power stages forming a full-bridge circuit. Power stages of this type may be used as power stages for the integrated circuit 52, although the particular circuitry used may require the introduction of certain changes. We are going to assume hereinafter that the two power stages 56 and 57 of the integrated circuit of FIG. 4 take the form shown in FIG. 7, wherefore FIG. 7 uses the same references for the signal inputs E1+, E1−, E2+, E2− and the outputs M1+, M1−, M2+, M2−. Further, FIG. 7 shows the connections for the positive and negative supply voltage for the motor and the positive supply voltage for the logic (+5 volts) as well as the ground connection for the logic (GND).

The circuit diagram of power stage 57 is absolutely identical to that of power stage 56, this applies also to the corresponding components. A pnp power transistor 70 has its emitter connected to the positive motor supply voltage and its collector connected to the output M1+. An npn power transistor 71 has its collector connected to output M1− and its emitter connected to the negative pole of the motor supply voltage. The two collector-to-emitter paths are shunted each by one diode 72 connected inversely to the polarity of the respective base-emitter diode. The diodes 72 serve as protection for the transistors 70 and 71. Each transistor 70, 71 has the base connection and the emitter connection interconnected via resistors 75 and 76, respectively, of equal value. The transistor 70 has connected to its base the collector of an npn transistor 78 whose emitter is connected via a resistor 79 to the ground potential terminal of the logic (GND). This connection is connected via a voltage source 80 to the base of the transistor 78 which is moreover connected via a resistor 81 to terminal E1+. In the example shown, the voltage source 80 takes the form of four diodes connected in series.

The base of transistor 71 is connected to the collector of a pnp transistor 84 whose emitter is connected via a resistor 85 to the positive supply voltage connection for the logic. The latter connection is in turn connected to the base of transistor 84, via a voltage source 86 which likewise takes the form of four diodes connected in series. The diodes of each of the voltage sources 80 and 86 have the same polarity as the base-emitter diode of the respective transistor. These diodes 80 and 86 coact with the resistors 81 and 82 to maintain the base voltage of the transistors 78 and 84 at an approximately constant level even in the presence of varying values for E1+, E1− and even if these values should rise up to +10 V, whereby they act to limit the base current and, thus, the power dissipation of the transistors 78 and 84. The base of transistor 84 is connected via a resistor 82 to terminal E1−. The signals encountered at the input terminals E1+ and E1−, and E2+ and E2−, which are the output signals of the operating mode responsive braking logic 65, may assume the levels +5 V and 0 V, related to logical ground. Now, when the two logic inputs E1+ and E1− are supplied with the same input signals of the logical value 0, i.e. 0 V, the upper power transistor 70—as shown in FIG. 7—is blocked, while the lower power transistor 71 of the power stage 56 is conductive so that the connection point between outputs M1+ and M1− is connected to the negative motor supply voltage of −15 V. When the signal logical 1, i.e. a voltage of +5 V, is applied to the two inputs E1+ and E1−, transistor 70 will be conductive and transistor 71 will be blocked, while the connection point of outputs M1+ and M1− is connected to +15 V.

When a voltage of 0 V is applied to input E1+ and a voltage of +5 V to input E1−, the outputs M1+ and M1− will be dead as both transistors 70 and 71 will be blocked.

The condition in which the voltage of +5 V is applied to input E1+ and a voltage of 0 V to input E1− is inadmissible in the circuit shown in which the two transistors 70 and 71 are directly interconnected, because such a condition would short-circuit the motor supply voltage. But this inadmissible condition is prevented by the interlocking provided by the pulse signal processing unit 64.

To operate the setting motor 9 in the forward sense—as shown in FIG. 7—the signal inputs E1+ and E1− must be supplied with the voltage +5 V while the signal inputs E2+ and E2− must be supplied with the voltage 0 V. If the motor is to be driven in the reverse sense, the above voltage values must be exchanged against each other.

In order to stop the setting motor 9 as rapidly as possible, not all of the transistors 70 and 71 of the two power stages 56 ad 57 are blocked when the setting motor 9 is switched off, but rather the input terminals E1, E2 of the two power stages 56 are connected to the voltage 0 V so that the two armature terminals of the setting motor 9 which are connected to the outputs of the power stages 56 and 57 are supplied with the negative supply voltage which means that the two connections of the armature are short-circuited. As a result thereof, the armature winding will produce a current which will have the sense indicated by 89 in FIG. 7 when the setting motor 9 is running in the forward sense. This current is allowed to pass through the collector-emitter path of transistor 71 as the latter has its base switched on. If the base voltage commonly used were selected for the transistors 71 of the two power stages, the current could not pass the transistor 71 of the power stage 57, the latter being a npn transistor. In this case, the current would flow via the diode 72 connected in parallel to this transistor. As at this diode a voltage drop of approx. 0.7 volts to 1 volt is encountered, an armature current will flow in the motor 9 only until its terminal voltage drops below the voltage just mentioned, whereupon the motor is no longer braked electrically, but only by the frictional forces to be overcome by it.

According to the invention, however, the resistance 85 of the two power stages 56 and 57 is selected small enough to ensure that the transistor 84 will supply to the base of the transistor 71 a base current in the range of 30 times the current necessary for the usual switching operation of the transistor. This enables the transistor 71 to be operated also in inverse sense, this inversely operated transistor causing only a voltage drop of approx. 50 to 100 mV. Accordingly, the setting motor 9 will be electrically braked until the terminal voltage drops to a considerably lower value so that it will be stopped much more rapidly than would be the case if the armature current could flow during the braking procedure within the power stage 57 only through diode 72. When the armature current is flowing in the sense shown in FIG. 7, the transistor 71 of power stage 56 would not, actually, need the above-mentioned high basic current, but grace to the described sizing of the resistances 85 it is no longer necessary to connect a higher base voltage to one of the transistors 71, if this should become necessary, so that the circuit as a whole is simplified. It goes without saying that the arrangement could also be such that the two transistors 71 are blocked, and the two transistors 70 are rendered conductive for braking the motor 9. In this case, the last-mentioned transistors would have to be supplied with the higher base current, compared to normal operation. In the described example, however, the resistances 79 are higher than the resistances 85 so that the transistors 70 will conduct current only from the emitter to the collector.

In the case of one particular setting motor 9, the mere switching-off of the current supply resulted in an afterrunning time of 3 seconds. When the circuit shown in FIG. 7 was used for operating the motor, with the transistors 71 not operated in inverse sense, the afterrunning time was reduced by the braking effect provided by diode 72 to approx. 0.5 seconds. Finally, when the circuit shown in FIG. 7 was used with the transistors 71 operated in inverse sense, the afterrunning time was as short as 7.5 ms.

It is another advantage of the circuit shown in FIG. 7 that although the positive and negative voltages to be switched are high, compared to the logic levels, one of its control inputs has the level 0 V. The other control input is supplied with a positive or negative switching potential, as the case may be. In our example the logic levels 0 V and +5 V have been used. This advantage applies also to each of the two power stages 56 and 57 separately, which will form a semi-bridge connection at any time the setting motor 9 in FIG. 7 interconnecting the two final stages is removed. In this case it is possible to connect one setting motor each between the connection point of connections M1+ and M1− and a fixed potential, in particular ground potential. The advantage of these semi-bridge connections is to be seen in the fact that a positive or negative voltage may be selectively connected to their circuit output formed by the interconnection of the connections M1+ and M1−.

In the example shown in FIG. 7, the following components have the following ratings:

transistor 70: BSV 16-16
transistor 71: BSX 46-16
transistor 78: BCY 59/X
transistor 84: BCY 79/VIII
diodes 72: 1N 4003
resistor 81: 2 kOhms
resistor 82: 6.2 kOhms
resistors: 75, 76: 82 kOhms
resistors: 79, 85: 82 kOhms
voltage sources 80, 86: 4 BAW 76 diodes each It is supposed that the described rapid braking of the setting motors 9 will not be needed for the colour zone feed control of a printing press. Therefore, it will be possible to use the semi-bridge connection for the setting motors serving to adjust the ink film thickness. A printing machine for multi-colour printing comprises in addition certain other setting means for ensuring the accuracy of register of the individual colours printed by the different printing units. These setting means are called registers. Considering that here extreme accuracy is required, it will as a rule be necessary to operate the setting motors in the abovedescribed full-bridge circuit which permits rapid braking of these setting motors. The terminal reference $\overline{FZ}$/RE has been selected as being indicative of the terms Farbzone (colour zone) and register. The adjustment of the registers will generally be carried out by the printer in the course of the printing process, but may also be effected automatically.

In our example, the cycle time, i.e. the period of time available for determining the desired value by the comparator arrangement and the transfer of the setting signals to the power stages, is approx. equal to 50 μs. The setting motors 9 are impulse-operated through pulse input $\overline{P}$, the period of time during which current flows in the motor being equal to 30 ms and the interval between two pulses being 270 ms in our example. Different groups of setting motors are sequentially supplied with the current pulses.

In the present example, the period of time required by a setting motor to pass the full setting range is equal to 8 seconds. The full setting range is subdivided into 256 individually selectable intervals. Thus, each of the said intervals or increments has a length of approx. 30 ms during which time the above-described electronic arrangement can perform 600 scannings of actual values and determine the corresponding setting signals. Considering that the printing machine with eight printing units described in our example requires approx. 24 setting motors for the registers in addition to the setting motors for the colour feed adjustment, i.e. a total of 280 setting motors, two scannings will be performed during each of the individually selectable 256 increments of each setting motor. This provides great safety against trouble in case a scanning process should be disturbed for any reason whatever.

FIG. 8 shows a full circuit which may be used instead of the circuit arrangement shown in FIG. 3 and which comprises a digital comparator arrangement. Here again, the actual values are picked up by the potentiometers 17, of which only two are shown in the drawing, one for the actual value 1, and one for the actual value 256. And here again, 64 integrated circuits 52 are provided which are additionally identified as IS 1 (integrated circuit 1) to IS 64. FIG. 8 shows only four of these integrated circuits.

The analog signals for the actual values generated by the potentiometers 17 are supplied to an analog multiplexer 120. A binary counter 135 which is advanced by a pulse generator 136, has 9 counting steps and as many outputs 141 to 149. The signals encountered at the eight highest-order outputs 142 to 149 are used as address signals which are supplied also to address inputs of the analog multiplexer 120. The actual value selected by the respective address is fed by the analog multiplexer 120 to an input of an analog-to-digital converter 150 which converts this analog signal into a binary 8 bit information which can be fed in parallel to a group of inputs 152 of a binary comparator 151. The analog-to-digital converter 150 receives its order to convert also from the lowest-order output 141 of the binary counter 135. The fact that the impulse recurrence frequency encountered at this output 141 is equal to double the advancing frequency of the addresses encountered at the outputs 142 to 149 ensures that the analog-to-digital converter 150 will receive a starting signal between the generation of two successive addresses.

A second group 153 of inputs of the binary comparator 151 is supplied with digital nominal values from a digital nominal value storage which is likewise supplied with the address signals from the binary counter 135 and which provides the binary comparator with that nominal value which corresponds to the actual value put through at the given time by the analog multiplexer 120. The digital nominal values fed to the inputs 156 of the nominal value storage 155 may be generated with the aid of an analog-to-digital converter from analog signals supplied, for instance, by potentiometers. But it is also possible to enter these nominal values into the nominal value storage 155 by means of a keyboard or a calculator or some binary data storage means.

The binary comparator 151 is a subtraction circuit which subtracts the signals applied to the inputs 152 from the signals applied to the inputs 153 each time a data ready output of the analog-to-digital converter 150 emits a signal to the binary comparator 151. Depending on the subtraction result, the binary comparator 151 will then emit an output signal either at output 160 (when the signal received at the inputs 152 was greater than that received at the inputs 153) or 161 (in the reverse case), it being understood that the two values must differ from each other by the minimum deviation described above; otherwise the binary comparator 151 will emit no output signal at all. The outputs 160 and 161 are connected to the data inputs $\overline{D}+$ and $\overline{D}-$ of the integrated circuit 52. The two lowest-order bits of the address present at the analog multiplexer are applied to the address inputs A0 and A1 of the integrated circuits 52, thus causing a pre-selection of the final stages of the individual integrated circuits. The chip selection itself is performed with the aid of a decoder 165 with 5 inputs and 32 outputs and with the aid of the highest-order address bit. To this end, the 64 integrated circuits 52 are subdivided into two groups IS1 to IS32 and IS33 to IS 64, respectively.

The CS 2 signal from the decoder 165 is applied to one integrated circuit in each group. Then one of the groups 1 to 32 and 33 to 64, respectively, is selected by the highest-order address bit which is applied to the CS 1 inputs, directly in the case of the first group and inversely via a negator 170 in the case of the other group. So, exactly one of the integrated circuits 52 is selected. The integrated circuits 52 in FIG. 8 are identical to those described with reference to FIG. 4.

The components used in the arrangement of FIG. 8 are as follows:

Analog Multiplexer 120: integrated circuit 7506 (Analog Devices),

Binary Counter 135: three integrated circuits 74163 (Texas Instruments),

Pulse Generator 136: integrated circuit 74320 (Texas Instruments),

Analog-Digital-Converter 150: integrated circuit AD 570 (Analog Devices),

Comparator 151: two integrated circuits 7485 (Texas Instruments),

Storage 155: integrated circuit 2114 (Intel),

Decoder 165: two integrated circuits 74154 (Texas Instruments),

Inverter 170: integrated circuit 7404 (Texas Instruments),

Potentiometer 17: 10-turn bushing mount wire wound element, resistance 2 kOhms, manufacturer: Spectrol (Italy).

Setting Motor 9: type 2230 F 012 S 228 with gearing 22/2; 97,3:1; −K 48; manufacturer: Dr. Fritz Faulhaber at Schönaich/Schwarzwald, Federal Republic of Germany.

FIG. 9 shows an integrated circuit 170 with the upper side of its case partly broken away, so that the semiconductor chip 172 can be seen which comprises the circuit shown in FIG. 4. The integrated circuit 170 has 22 pins 174 for connecting the circuit.

The circuit shown in FIG. 7 may also be built using separate components (transistors, resistors etc.) instead of an integrated circuit. When using separate components, the components indicated on page 31 and 32 of this specification may be used. However, when the circuit is built as a integrated circuit, the components are integrated on the semiconductor chip so that the integrated components have the properties of the components shown in the paragraph bridging the pages 31 and 32.

To the extent certain circuit details have not been described, for example in connection with FIG. 4, reference is made to the drawing.

What we claim is:

1. A printing press comprising a plurality of individually and simultaneously operable setting motors, each setting motor being connected to a pick-up generating electric signals characteristic of an actual position of the respective setting motor at any given moment and representing a given actual value, comprising an electronic comparator device having means for receiving respective actual values supplied thereto and means for receiving desired values for the position of the respective setting motors, said electronic comparator device having means for repeatedly scanning the actual values in a cyclical time sequence for comparing the actual values with the respective desired values to form setting signals for simultaneously operating the respective setting motors in the forward and reverse direction when a given positive and negative minimum deviation, respectively, is exceeded, as well as setting signals for stopping said setting motors, and a switching arrangement having means for receiving said setting signals, respectively, and , in response thereto, for driving the respective setting motors simultaneously, at a predetermined speed, in said forward and reverse direction, respectively, determined by a last preceding setting signal until a next succeeding setting signal relating to the respective motors is received, and for stopping the respective setting motors, respectively.

2. A press in accordance with claim 1 wherein, in the switching arrangement, each of said setting motors is operatively associated with an electronic storage for storing the setting signal.

3. A press in accordance with claim 1 wherein said comparator device has means for generating, together with each setting signal, an address signal relating to a respective setting motor just being scanned, and means for feeding the address signal to an address decoding circuit for transmitting the setting signal to the addressed storage associated with the respective setting motor.

4. A press in accordance with claim 3 including means for switching said address decoding circuit over in response to an operating mode signal representing two possible operating modes so that, in one of said operating modes, one address is associated with one storage only, while in the other of said operating modes, one address is associated with two storages.

5. A press in accordance with claim 1 wherein said comparator device comprises an analog comparator for comparing the desired values with the actual values.

6. A press in accordance with claim 1 wherein said comparator device comprises a digital comparator for comparing the desired values with the actual values.

7. A press in accordance with claim 4, wherein said one operating mode is a semi-bridge circuit and said other operating mode is a full-bridge circuit, and including a logic braking circuit actuatable, upon receipt of a "stop" setting signal, to emit a control signal for a connected power stage with switches arranged in the full-bridge circuit connection for switching on two switches connected to the same pole of a supply voltage source of the respective setting motor.

8. A press in accordance with claim 7, wherein said logic braking circuit is switchable on by the operating mode signal indicating full-bridge circuit connection.

9. A press in accordance with claim 2 including a control device arranged behind the storage which ensures that the electric energy required for driving the setting motors is supplied successively to only a certain part of the total number of setting motors during a pre-determined period of time.

10. A press in accordance with claim 1 wherein said comparator device has means for detecting when any of several different minimum deviations corresponding to different tolerance ranges is exceeded by the actual values, and including switching means for initially actuating given ones of said setting motors to run at a first, pre-determined speed, said given setting motors being stopped when a first tolerance range is entered, and said switching means being then actuable for causing said given setting motors to run at a speed lower than the said first speed and for switching said comparator device over to a tolerance range smaller than said first tolerance range.

11. A press in accordance with claim 1, wherein said switching arrangement comprises at least one integrated circuit which has at least one power stage for connection of a motor and a control logic for controlling the power stage provided on one and the same chip.

12. A press in accordance with claim 11, wherein said integrated circuit comprises:

power stages controllable in response to the setting signals for connection of at least two setting motors, at least one address input for addressing the power stages, at least one data input for the setting signals and at least one storage device for each power stage for storing the setting signals.

13. A press in accordance with claim 10, wherein said integrated circuit comprises power stages for connection of a total of four setting motors.

14. An integrated circuit for a switching arrangement of a printing press including a plurality of individually and simultaneously operable setting motors, each setting motor being connected to a pick-up generating electric signals characteristic of an actual position of the respective setting motor at any given moment and representing a given actual value, an electronic comparator device having means for receiving respective actual values supplied thereto and means for receiving desired values for the position of the respective setting motors, said electronic comparator device having means for repeatedly scanning the actual values in a cyclical time sequence for comparing each of the actual values with the respective desired values to form setting signals for operation of the respective setting motors in the forward and reverse direction when a given positive and negative minimum deviation, respectively, is exceeded, as well as setting signals for stopping said setting motors, and a switching arrangement having means for receiving said setting signals respectively, and, in response thereto, for driving the respective setting motors, at a pre-determined speed, in said forward and reverse direction, respectively, determined by a last preceding setting signal unitl a next succeeding setting signal relating to the respective motors is received, and for stopping the respective setting motors, respectively, said switching arrangement having at least one power stage for connection of a motor and a control logic for controlling the power stage provided on the same chip.

15. An integrated circuit in accordance with claim 14, comprising a plurality of power stages controllable in response to the setting signals, for connection of at least two setting motors, at least one address input for addressing the power stages, at least one data input for the setting signals, and at least one storage device for each power stage for storing the setting signals.

16. An integrated circuit in accordance with claim 12, wherein said integrated circuit comprises power stages for connection of a total of four setting motors.

* * * * *